US006568574B2

(12) United States Patent
Jones et al.

(10) Patent No.: US 6,568,574 B2
(45) Date of Patent: May 27, 2003

(54) WATERPROOF BODY POUCH BAND

(76) Inventors: Kathleen W. Jones, 2375 University St., Eugene, OR (US) 97403; Jennifer J. Houck, 4990 Whiteaker St., Eugene, OR (US) 97405

( * ) Notice: Subject to any disclaimer, the term of this patent is extended or adjusted under 35 U.S.C. 154(b) by 0 days.

(21) Appl. No.: 09/798,666

(22) Filed: Mar. 2, 2001

(65) Prior Publication Data

US 2001/0035443 A1 Nov. 1, 2001

Related U.S. Application Data

(60) Provisional application No. 60/186,691, filed on Mar. 3, 2000.

(51) Int. Cl.[7] ..... A45F 3/14

(52) U.S. Cl. ..... 224/222; 224/219; 224/660; 383/59; 383/63

(58) Field of Search ..... 224/222, 219, 224/660, 661, 235, 587; 383/59, 61.1, 63, 113

(56) References Cited

U.S. PATENT DOCUMENTS

| | | | | | |
|---|---|---|---|---|---|
| D33,980 | S | * | 1/1901 | Mitchell | 224/219 |
| 1,445,528 | A | * | 2/1923 | Marsh | 224/222 |
| D248,057 | S | | 5/1978 | Heimler | |
| D249,592 | S | | 9/1978 | Libonati | |
| D255,509 | S | | 6/1980 | Nathan | |
| D258,246 | S | * | 2/1981 | Kravchenko | 224/222 |
| D273,344 | S | | 4/1984 | Lee | |
| D280,255 | S | | 8/1985 | Blaivas | |
| 4,562,834 | A | * | 1/1986 | Bates et al. | 36/7.1 R |
| 4,905,881 | A | | 3/1990 | Graber | |
| D323,939 | S | | 2/1992 | Mok | |
| 5,244,136 | A | * | 9/1993 | Collaso | 224/235 |
| D340,806 | S | * | 11/1993 | Gonzalez | D3/226 |
| 5,540,366 | A | * | 7/1996 | Coomber | 224/587 |
| D373,900 | S | | 9/1996 | Montgomery | |
| 5,755,766 | A | | 5/1998 | Mazzo | |
| 5,938,089 | A | * | 8/1999 | Abreu-Marston | 224/222 |
| 6,112,961 | A | | 9/2000 | Phillips | |

FOREIGN PATENT DOCUMENTS

| | | | | |
|---|---|---|---|---|
| CH | 000624295 A5 | * | 7/1981 | 224/222 |

OTHER PUBLICATIONS

Trident Diving Equipment Catalog, 1999, cover p. 21 (see item D 631).

* cited by examiner

*Primary Examiner*—Stephen K. Cronin
*Assistant Examiner*—Maerena W. Brevard
(74) *Attorney, Agent, or Firm*—Robert E. Howard

(57) ABSTRACT

A body pouch band for carrying personal effects on the limb of a user. The body pouch band includes a pouch having front and rear walls and side, top and bottom edges. The side and bottom edges can be gusseted. The top of the pouch can be fastened shut by use of an interlocking groove type sealing mechanism. The pouch is attached to a limb band which can be fastened to the wrist, upper arm, or ankle of a user. The limb band is made of stretchable material, and can be a cuff or a sleeve. The cuff embodiments have stretchable straps or bands that are either releasably fastened together at their outer ends, such as by use of hook and loop fastener material, or permanently fastened at their outer ends, such as by sewing. The sleeve embodiments are made of stretchable material, and are adapted to be slid into position over the selected limb portion of the user. In the sleeve embodiment for use over the upper arm, opposing holes pass through the wall of the sleeve to provide improved flexibility. The pouch and limb band are preferably made of waterproof materials so that the body pouch band may be worn during water sports.

22 Claims, 4 Drawing Sheets

WATERPROOF BODY POUCH BAND

CROSS-REFERENCE TO RELATED APPLICATIONS

This application claims the benefit of U.S. Provisional Application No. 60/186,691, filed Mar. 3, 2000.

BACKGROUND OF THE INVENTION

This invention relates to a waterproof body pouch band that can be worn on the upper arm, forearm (wrist) or lower leg (ankle).

Swimmers, skin divers, and other persons engaged in water sports generally cannot carry personal items, such as drivers license, keys, money, etc. with them while they are in the water.

It would be very desirable for the swimmer or diver to be able to carry at least a minimum amount of such personal items with them while they are in the water without such items interfering with their swimming or diving activity.

SUMMARY OF THE INVENTION

It is an object of this invention to provide a waterproof body pouch band that may be used by swimmers, divers, and other persons engaged in water sports that can be used to carry selected personal items with them into the water instead of leaving these items hidden on land.

The body pouch band includes a waterproof pouch having front and rear walls and side, top and bottom edges. The side and bottom edges can be gusseted. The top edges of the pouch can be fastened shut by use of an interlocking groove type sealing mechanism. The pouch is attached to a stretchable limb band which can be fastened to the wrist, upper arm, or ankle of a user. The limb band can be a cuff or a sleeve.

The cuff embodiments of the present invention have stretchable straps or bands that are either releasably fastened together at their outer ends, preferably by use of hook and loop fastener material, or permanently fastened together at their outer ends, preferably by sewing.

The sleeve embodiments of the present invention are made of stretchable material, and are adapted to be slid into position over the selected limb portion of the user. The sleeve can be tapered. In the sleeve embodiment for use over the upper arm, opposing holes pass through the web of the sleeve to provide improved flexibility.

The pouch and limb band are preferably made of waterproof materials so that the body pouch band may be worn during water sports.

DESCRIPTION OF PREFERRED EMBODIMENTS

Figure 1:
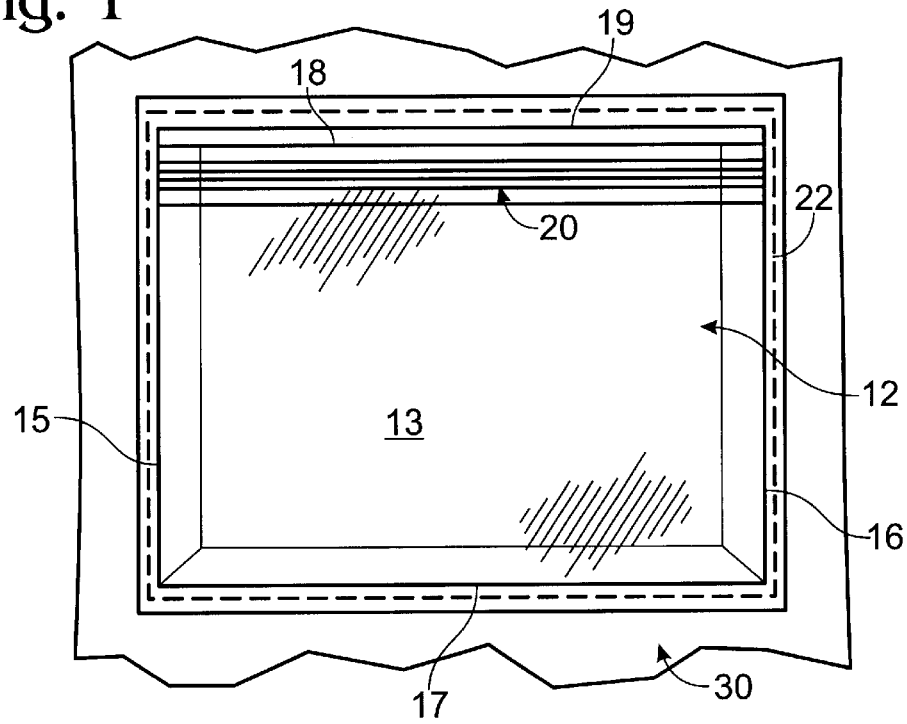
FIG. 1 is a partial top plan view of the waterproof body pouch band of the present invention.
Figure 2:
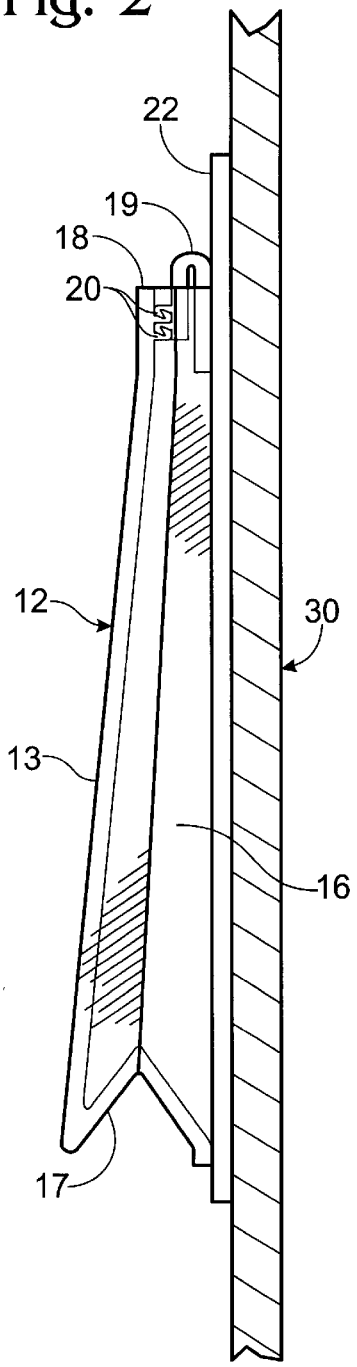
FIG. 2 is a partial side elevational view of the waterproof body pouch band of FIG. 1.

In FIGS. 1 and 2 a first embodiment of a waterproof pouch 12 is shown. Waterproof pouch 12 has a front wall or panel 13, a rear wall or panel 22, gusseted side edges 15 and 16, and gusseted bottom edge 17.

The outer edges of rear wall 22 extend beyond the outer edges of front wall 13, as shown. This provides a margin around the perimeter of waterproof pouch 12, in which margin the pouch 12 may be sewn to limb band 30 (only partially shown in FIGS. 1–3) without impairing the waterproof integrity of the interior of waterproof pouch 12. The stitch line where waterproof pouch 12 is attached to limb band 30 is shown by the dotted lines in FIGS. 1–3.

The inner edges of gusseted side edges 15 and 16, and the inner edge of gusseted bottom edge 17, are attached to rear wall 22 by welding.

Front wall 13 has a top edge 18. A flap 19, welded to rear wall 22, is in juxtaposition to top edge 18.

Waterproof pouch 12 can be made of any waterproof material, preferably a flexible, non-porous plastic material. The plastic material from which waterproof pouch 12 is formed may be transparent, translucent or opaque.

The size of the waterproof pouch 12 is selected to be comfortable on the wrist of a user, but preferably is large enough to contain a driver's license and/or credit card. A suitable pouch size for most uses is one having a length of about 3.75 inches and a height of about 2.75 inches.

By providing that side edges 15 and 16 and bottom edge 17 are gusseted, pouch 12 is expandable to provide a larger volume for carrying items.

An interlocking groove "press shut" type sealing or locking mechanism 20 is preferably of the type used on plastic storage bags sold under the trademark "ZIPLOC". Sealing mechanism 20 is formed by interlocking grooves located adjacent the top edge 18 of front wall 13 and in flap 19, as shown. The press shut sealing mechanism 20 is used to lock top edge 18 and flap 19 together in a watertight manner when operably engaged. When not operably engaged, top edge 18 and flap 19 form the mouth of waterproof pouch 12, which mouth provides access to the interior of waterproof pouch 12.

Alternatively, the newer type interlocking groove type sealing mechanism employing a sliding fastener may be used as sealing mechanism 20.

Figure 3:
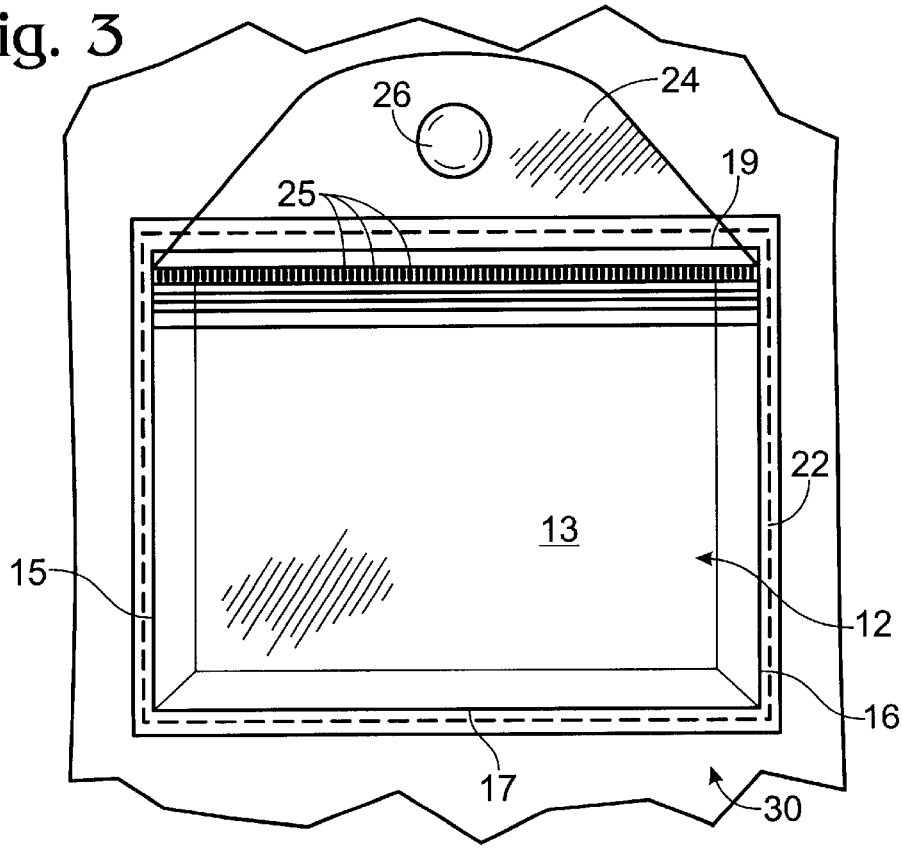
FIG. 3 is a partial top plan view of a second embodiment of the waterproof body pouch band of the present invention.

FIG. 3 shows a second embodiment of waterproof pouch 12 in which a flexible, transparent, plastic flap 24 is attached to and extends above top edge 18. Flap 24 is attached at its base to top edge 18 of front wall 13 by any suitable attachment means, such as press weldment 25 where front wall 13 and flap 24 are plastic. Flap 24 has a snap 26 adapted to engage and lock into a snap receptacle (not shown) attached to cuff 30 and in alignment with snap 26 when snap 26 is in the position shown in FIG. 3. Flap 24 covers the mouth of waterproof pouch 12 and provides additional waterproof protection to the mouth. Flap 24, when unsnapped, can be used as a pull tab to disengage sealing mechanism 20.

Figure 4:
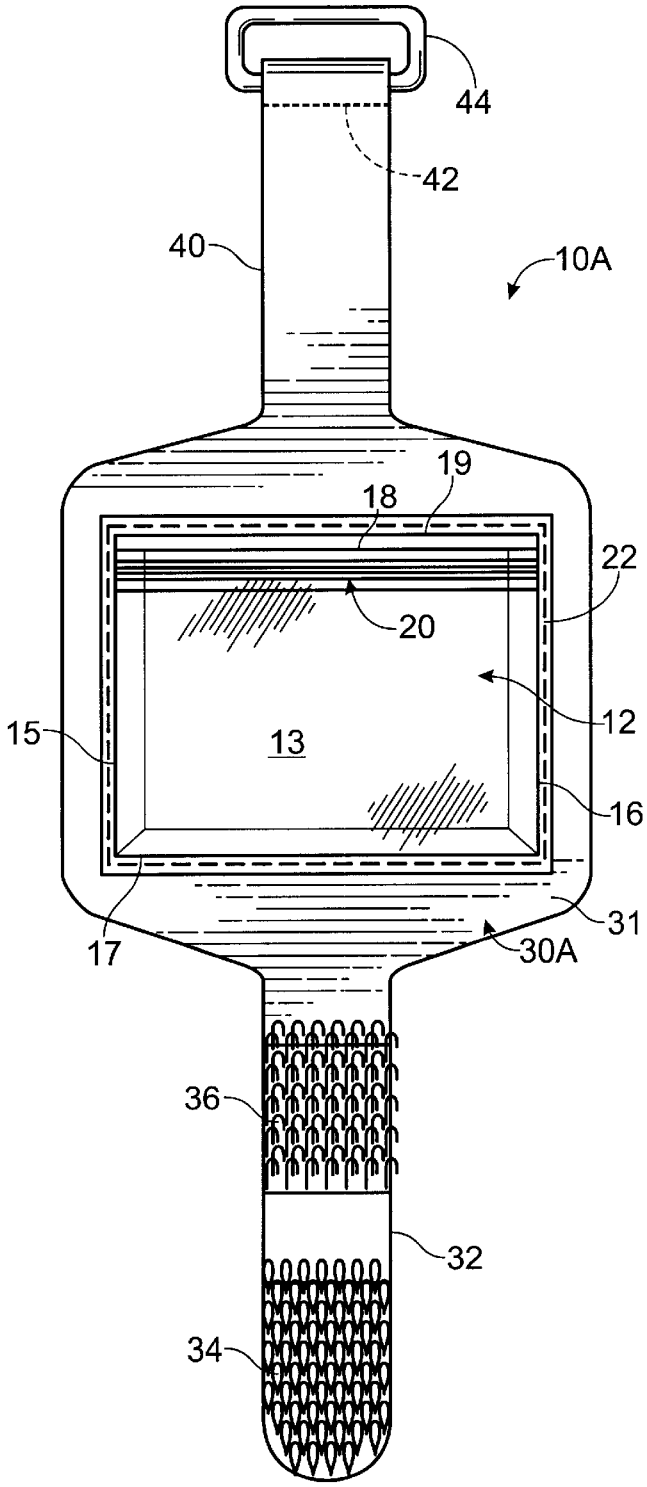
FIG. 4 is a top plan view of one cuff embodiment of the body pouch band of the present invention, for wearing on the wrist.

FIG. 4 shows a first embodiment of the body pouch band 10A adapted to be worn on the wrist wherein the limb band is cuff 30A. A first strap 32 extends downwardly from the bottom edge of main body portion 31 of cuff 30A, first strap 32 being integral with or attached to the main body portion 31. The outer end of strap 32 contains the first component 34 of hook and loop fastener material. Adjacent to the inner end of first strap 32 is the second component 36 of hook and loop fastener material. The components 34 and 36 extend a distance sufficient to provide fastening ability for a range of wrist sizes. By first and second "components" is meant that one component is the hook material and the other component is the loop material that typically form a hook and loop fastener.

A suitable hook and loop fastener material is sold under the trademark "VELCRO".

A second strap 40 extends upwardly from the top edge of main body portion 31 of cuff 30A and is integral with or attached thereto. The outer end of strap 40 is looped back on itself and sealed along seal line 42 to form a sleeve for ring or buckle 44.

Main body portion 31 and straps 32 and 40 are formed from a waterproof material having four way stretch characteristics, such as neoprene fabric.

In operation the user places selected personal items inside waterproof pouch 12 and seals the pouch shut by means of sealing mechanism 20. The rear wall of main body portion 31 of cuff 30A is placed against the user's wrist. First strap 32 is then wrapped around the user's wrist and through ring 44. The first component 34 of the hook and loop fastener located at the outer end of first strap 32 is pulled tight and folded back so that first component 34 engages and becomes attached to second component 36 to thereby tightly fasten the body pouch band 10A to the user's wrist by means of the hook and loop fastener material.

Figure 5:
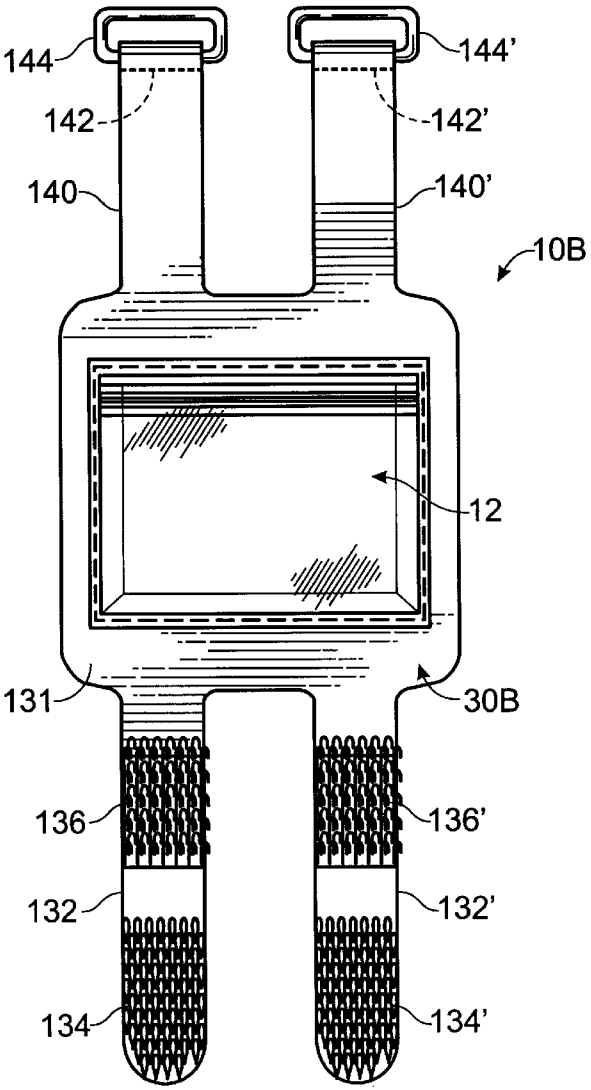
FIG. 5 is a top plan view of a second cuff embodiment of the body pouch band of the present invention, for wearing on the wrist.

A variation of the embodiment illustrated in FIG. 4 is illustrated in FIG. 5. FIG. 5 shows body pouch band 10B adapted to be worn on the wrist wherein the limb band is cuff 30B. A pair of first straps 132 and 132' extend downwardly from the bottom edge of main body portion 131 of cuff 30B, first straps 132 and 132' being integral with or attached to the main body portion 131. The outer end of straps 132 and 132' contain the first component 134 and 134' of hook and loop fastener material. Adjacent to the inner ends of first straps 132 and 132' are the second component 136 and 136' of hook and loop fastener material. The components 134, 134', 136 and 136' extend a distance sufficient to provide fastening ability for a range of wrist sizes.

Second straps 140 and 140' extend upwardly from the top edge of the main body portion 131 of cuff 30B and are integral with or attached thereto. The outer ends of straps 140 and 140' are looped back on themselves and sealed along seal lines 142 and 142', respectively, to form sleeves for rings or buckles 144 and 144'.

Main body portion 131, and straps 132, 132', 140 and 140' are formed from a waterproof material having four way stretch characteristics, such as neoprene fabric.

The embodiments of FIGS. 4 and 5 show the straps to be releasably attached at their outer ends. These embodiments may be modified by permanently attaching the strap ends together at their outer ends, such as by sewing. Since the straps are formed of stretchable material, they are self-adjusting to different size body limbs.

Figure 6:
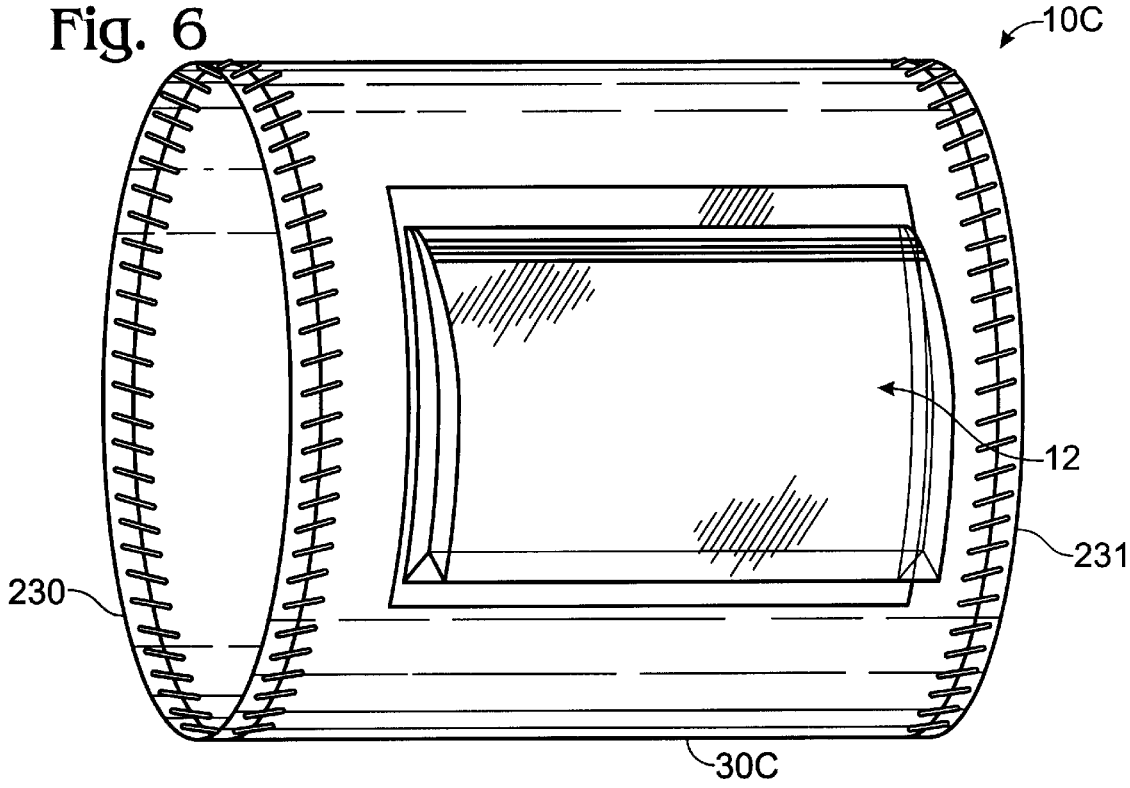
FIG. 6 is a perspective view of a first sleeve embodiment of the body pouch band of the present invention, for wearing on the wrist.

FIG. 6 illustrates a body pouch band 10 having a limb band in the form of a substantially cylindrical flexible sleeve 30C for use on a user's wrist. Waterproof pouch 12 is attached to sleeve 30C, as shown. Sleeve 30C is slightly tapered from its upper end 230 to its lower end 231 to approximate the natural taper present in a user's lower arm and wrist area.

Figure 7:
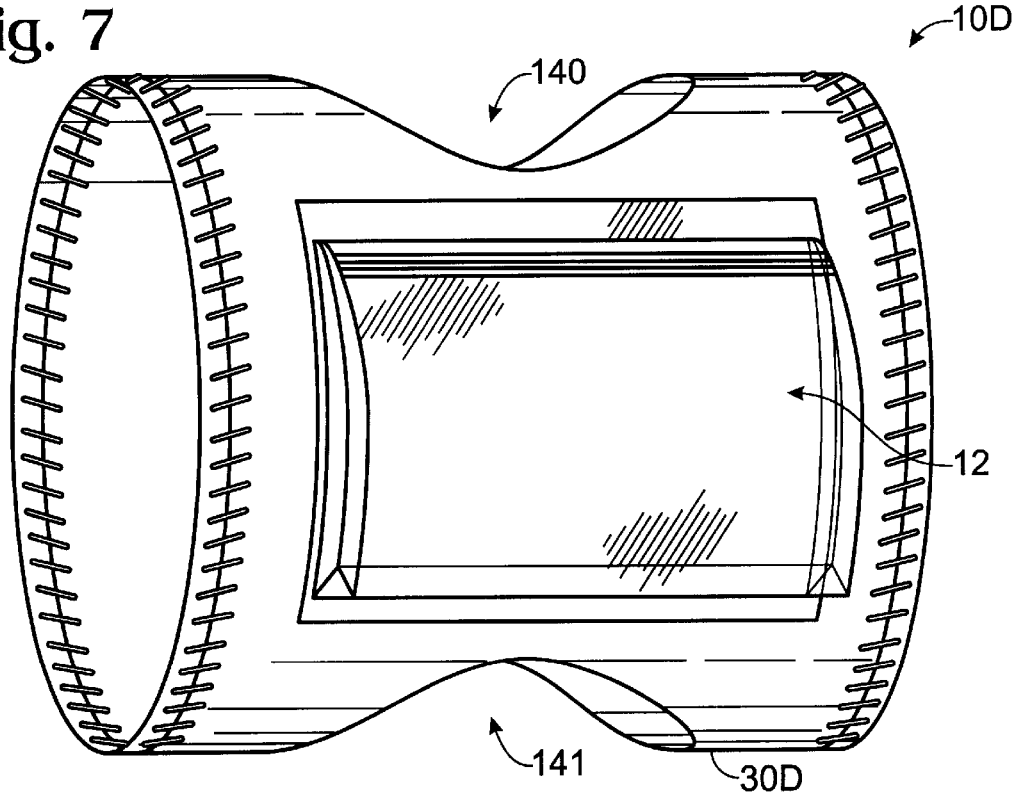
FIG. 7 is a perspective view of a second sleeve embodiment of the body pouch band of the present invention adapted to be worn on the upper arm.

FIG. 7 illustrates a body pouch band 10D in the form of a flexible sleeve 30D for use on a user's upper arm. Waterproof pouch 12 is attached to sleeve 30D, as shown. Opposing circular holes 140 and 141 pass through the wall of sleeve 30D at the mid-portion thereof, the centers of holes 140 and 141 being substantially 180 degrees apart from each other, each such center being substantially 90 degrees from the center of waterproof pouch 12.

The purpose of holes 140 and 141 is to provide more flexibility to sleeve 30D, making it more comfortable to wear, and the size of the holes may be selected to maximize such comfort. It has been found that holes 140 and 141 having a diameter of about 50% of the width of sleeve 30D provides satisfactory flexibility. Without holes 140 and 141 sleeve 30D would act and feel like a tourniquet.

Sleeves 30C and 30D are made of waterproof material having four way stretch characteristics, such as neoprene fabric. Sleeves 30C and 30D are made from flat sheets of the stretchable fabric whose ends are attached together, such as by sewing, to form the substantially cylindrical sleeve wall. Waterproof pouch 12 is attached to the middle of the flat sheet from which the sleeves are made, with the seam formed at the juncture of the ends being substantially 180 degrees from the mid-point of pouch 12.

Figure 8:
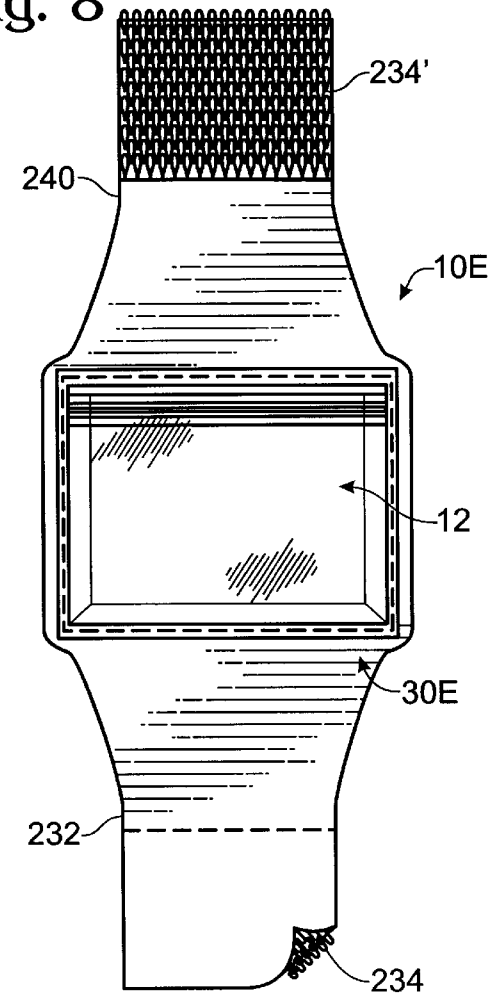
FIG. 8 is a top plan view of an embodiment of the body pouch band of the present invention adapted to be worn around the ankle.

FIG. 8 illustrates a body pouch band 10E for use on the wrist or ankle areas of a user. Body pouch band 10E has an adjustable cuff 30E comprised of first and second bands 232 and 240 extending from the bottom and top edges, respectively, of the main body portion and are integral therewith. The outer end of first band 232 has a first component of hook and loop fastener material 234 on its underside extending from its outer end to the dotted line, and the outer end of second band 240 has the second component of hook and loop fastener material 234' at its upper, outer end.

The embodiment of FIG. 8 shows the bands 232 and 240 to be releasably attached at their outer ends. This embodiment may be modified by permanently attaching the band ends together at their outer ends, such as by sewing. Since the bands are formed of stretchable material, they are self-adjusting to different size body limbs.

While it is preferred that body pouch band 10 be made of waterproof material so that it can be worn during water sports, it is clear that the waterproof body pouch band could be worn in non-water settings. If the body pouch band 10 is to be used strictly in non-water settings, it can be made of non-waterproof materials.

In the preferred embodiments discussed above, the side edges 15 and 16 and the bottom edge 17 of waterproof pouch 12 are gusseted. For uses where less space is needed, the side edges and bottom edge of front wall 13 can be attached directly to back wall 22 without employing gussets.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A waterproof body pouch band adapted to be worn on the arm or leg of a user comprising:

a waterproof pouch having a front wall and a back wall, said front and back walls each having a top edge, a bottom edge, and substantially parallel side edges, said top, bottom and side edges of said back wall extending beyond said top, bottom and side edges of said front wall, respectively, to form a margin around the periphery of said back wall, said side edges and said bottom edge of said front wall being attached to said back wall by waterproof attachment means;

sealing means adapted to releasably seal said top edge of said front wall to that portion of said rear wall in juxtaposition therewith in a waterproof manner when said sealing means is operably engaged, said top edge of said front wall and that portion of said rear wall in juxtaposition therewith forming an opening into said waterproof pouch when said sealing means is not operably engaged; and a limb band having a main body portion having substantially parallel side edges, said waterproof pouch being attached to said main body portion of said limb band by attachment means located in said margin, said parallel side edges of said limb band being parallel to said side edges of said front and back walls of said pouch, said limb band having means for releasably securing said limb band to the arm or leg of a user, said means extending outwardly from said main body portion in a direction substantially parallel to said substantially parallel side edges of said main body portion and perpendicular to said top and bottom edges of said front and back walls of said pouch for a distance adapted to encircle the arm or leg of said user.

2. The body pouch band of claim 1 including a flap attached to said front wall of said waterproof pouch above said sealing means, said flap extending upwardly over said opening in said pouch, said flap having means for removably attaching said flap to said limb band.

3. The body pouch band of claim 1 wherein said sealing means is an interlocking groove.

4. The body pouch band of claim 1 wherein said waterproof pouch is made of a flexible plastic material.

5. The body pouch band of claim 1 wherein said limb band is a cuff, said cuff including at least one first strap member extending upwardly from the top edge of said main body portion of said cuff and at least one second strap member extending downwardly from the bottom edge of said main body portion of said cuff, said first and second strap members being attachable to each other at their outer ends to releasably secure said limb band to the limb of a user.

6. The body pouch band of claim 5 wherein said cuff is made of stretchable material.

7. The body pouch band of claim 5 wherein said cuff is made of neoprene fabric.

8. The body pouch band of claim 5 wherein said first and second strap members are releasably attached to each other at their outer ends.

9. The body pouch of claim 8 wherein said first and second strap members are releasably attached to each other at their outer ends by hook and loop fastener material.

10. The body pouch of claim 5 wherein said first and second strap members are permanently attached to each other at their outer ends.

11. The body pouch of claim 10 wherein said strap members are permanently attached to each other at their outer ends by sewing.

12. The body pouch band of claim 5 wherein there are one each of said first and second strap members.

13. The body pouch band of claim 5 wherein there are two each of said first and second strap members.

14. The body pouch band of claim 13 wherein said first and second strap members are permanently attached together at their outer ends.

15. The body pouch band of claim 1 wherein said limb band is a sleeve having first and second ends and a substantially cylindrical wall extending between said first and second ends, said sleeve being adapted to fit around a limb of said user.

16. The body pouch band of claim 15 wherein said sleeve is made of stretchable material.

17. The body pouch band of claim 16 wherein said sleeve is made of neoprene fabric.

18. The body pouch band of claim 15 wherein said sleeve is tapered between its first and second ends.

19. The body pouch band of claim 15 wherein said sleeve has opposing circular openings passing through said cylindrical wall thereof.

20. A waterproof body pouch band adapted to be worn on the arm or leg of a user comprising:

a waterproof pouch having a front wall and a back wall, said front and back walls each having a top edge, a bottom edge, and substantially parallel side edges, said top, bottom and side edges of said back wall extending beyond said top, bottom and side edges of said front wall to form a margin around the periphery of said back wall, said side edges and said bottom edge of said front wall having gussets formed therein, said side edges and said bottom edge of said front wall being attached to said back wall by waterproof attachment means;

sealing means adapted to releasably seal said top edge of said front wall to that portion of said rear wall in juxtaposition therewith in a waterproof manner when said sealing means is operably engaged, said top edge of said front wall and that portion of said rear wall in juxtaposition therewith forming an opening into said waterproof pouch when said sealing means is not operably engaged; and a limb band having a main body portion having substantially parallel side edges, said waterproof pouch being attached to said main body portion of said limb band by attachment means located in said margin, said substantially parallel side edges of said limb band being substantially parallel to said side edges of said front and back walls of said pouch, said limb band having means for releasably securing said limb band to the arm or leg of a user, said means extending outwardly from said main body portion in a direction parallel to said parallel side edges of said main body portion and perpendicular to said top and bottom edges of said front and back walls of said pouch for a distance adapted to encircle the arm or leg of said user.

21. A waterproof body pouch band adapted to be worn on the arm or leg of a user comprising:

a waterproof pouch having a front wall and a back wall, said front and back walls each having a top edge, a bottom edge, and substantially parallel side edges, said side edges and said bottom edges of said front and back walls being attached to each other and to said back wall by waterproof attachment means;

sealing means adapted to releasably seal said top edge of said front wall to that portion of said rear wall in juxtaposition therewith in a waterproof manner when said sealing means is operably engaged, said top edge of said front wall and that portion of said rear wall in juxtaposition therewith forming an opening into said waterproof pouch when said sealing means is not operably engaged; and a limb band having a main body portion having substantially parallel side edges, said waterproof pouch being attached to said main body portion of said limb band with said substantially parallel side edges of said main body portion being substantially parallel to said side edges of said front and back walls of said pouch, said limb band having means for releasably securing said limb band to the arm or leg of a user, said means extending outwardly from said main body portion in a direction substantially parallel to said substantially parallel side edges of said main body portion and substantially perpendicular to said top and bottom edges of said front and back walls of said pouch for a distance adapted to encircle the arm or leg of said user.

22. The body pouch band of claim 21 wherein said side edges and said bottom edge of said front wall of said pouch have gussets formed therein.

* * * * *